US010479596B2

(12) United States Patent
Pea

(10) Patent No.: US 10,479,596 B2
(45) Date of Patent: Nov. 19, 2019

(54) PACKAGING FOR TEXTILE ARTICLES

(71) Applicant: TECNOPEA S.R.L., Quinzano D'Oglio (BS) (IT)

(72) Inventor: Gianfranco Pea, Quinzano D'Oglio (IT)

(73) Assignee: TECNOPEA S.R.L., Quinzano D'oglio (IT)

( * ) Notice: Subject to any disclaimer, the term of this patent is extended or adjusted under 35 U.S.C. 154(b) by 73 days.

(21) Appl. No.: 15/672,465

(22) Filed: Aug. 9, 2017

(65) Prior Publication Data

US 2018/0229922 A1 Aug. 16, 2018

(30) Foreign Application Priority Data

Feb. 14, 2017 (IT) ..... 102017000015846

(51) Int. Cl.
*B65D 5/06* (2006.01)
*B65D 85/18* (2006.01)
*B65B 5/06* (2006.01)

(52) U.S. Cl.
CPC ..... *B65D 85/18* (2013.01); *B65B 5/06* (2013.01)

(58) Field of Classification Search
CPC ..... B65D 85/18; B65D 5/06
See application file for complete search history.

(56) References Cited

U.S. PATENT DOCUMENTS 2,081,002 A * 5/1937 Curtis ..... A45C 13/02 206/293
2,421,487 A * 6/1947 Dyck ..... B42D 5/001 281/50
2,767,892 A * 10/1956 Cole ..... B65D 85/182 206/297
3,344,917 A * 10/1967 Raffet ..... B65D 71/02 206/451
3,561,595 A * 2/1971 Weggeland ..... G11B 23/0236 206/387.1
3,841,477 A * 10/1974 Stark ..... B65D 71/02 206/425
5,878,520 A * 3/1999 Milbrandt ..... G09F 3/14 24/16 PB
6,651,810 B2 * 11/2003 Nichol, Jr. ..... B65D 73/0064 206/278
6,901,636 B2 * 6/2005 Kim ..... B65D 63/1018 24/16 PB (Continued)

FOREIGN PATENT DOCUMENTS

AT 262876 B 6/1968
FR 639298 A 6/1928
FR 2399365 A1 3/1979

*Primary Examiner* — Tri M Mai
(74) *Attorney, Agent, or Firm* — Pearne & Gordon LLP

(57) ABSTRACT

The present invention relates to packaging 10 for textile articles 12. The packaging comprises: a plurality of textile articles overlapping in an X stacking direction, forming at least one pile 14; a flat core 16 arranged substantially perpendicular to the X stacking direction, wherein the flat core comprises recesses 18 along a pair of sides 160; and a small band 20, which surrounds the at least one pile of textile articles and the flat core. In the packaging according to the invention, the band is tied around the pile so as to keep it together and it is received in the recesses of the flat core. The invention also relates to a method for packaging textile articles.

9 Claims, 6 Drawing Sheets

(56) References Cited

U.S. PATENT DOCUMENTS

| | | | | |
|---|---|---|---|---|
| 7,516,569 | B2 * | 4/2009 | Garcia | G06Q 90/00 40/665 |
| 2002/0139697 | A1 | 10/2002 | Nichol | |
| 2004/0084334 | A1 | 5/2004 | Nichol | |
| 2009/0294311 | A1 * | 12/2009 | Caldwell | B65D 75/02 206/281 |
| 2014/0096424 | A1 * | 4/2014 | Ludlow | G09F 3/14 40/665 |
| 2014/0116904 | A1 | 5/2014 | Fosbury et al. | |

* cited by examiner

PACKAGING FOR TEXTILE ARTICLES

The present invention relates to packaging for textile articles and a method for packaging textile articles. In the following document, particular reference will be made to sports socks intended for sale in the large-scale retail trade. This specific reference is given by way of example and is not limiting and an expert can immediately understand how the invention can also be used in other similar fields.

Sports socks intended for sale through the large-scale retail trade are an item whose unit value is rather limited. They are typically made of terry fabric, often from regenerated yarns characterised by rather short fibres.

Their sale through the large-scale retail trade favours multi-packs, with each pack containing up to 10 or 12 pairs of socks.

In order to join so many pairs of socks in one single pack, the use of securing devices made of polymeric material, with the ends shaped in a T is known. Said devices are marketed, for example, together with the necessary equipment for applying them, by Avery Dennison Corporation in Glendale, USA, under the trade name of Swiftach®. For the sake of brevity, in the following document said securing devices will be referred to as "T-end fasteners".

T-end fasteners are usually made of thermoplastic polymeric material, for example polypropylene (PP), polyurethane (PU) or polyamide (PA).

Devices are used to apply the T-end fasteners comprising a hollow needle with a slit at the side. The needle is substantially as long as the T-end fastener to be applied. The distal end of the T-end fastener is inserted in the hollow needle and bent over so that it is aligned with the axis of the needle. A small piston moves inside the hollow needle, pushing the end of the T-end fastener along the hollow needle until it is released outside. When the end of the fastener comes out of the needle, it takes on its T shape again, thus preventing the fastener from coming off.

To pack a plurality of pairs of sports socks, the practice of overlapping them to form a pile, compacting the pile and applying a T-end fastener to keep the pile together is therefore known. To obtain several packs, two different piles are often placed side by side, each of which is joined by its own T-end fastener. The two piles can then be joined together by means of applying a band, for example made of paper or cardboard, suitable for containing the brand and information relating to the socks.

Thus, if we imagine a multi-pack containing 12 pairs of socks, we have two piles joined by 6 pairs of socks each. Since the socks are often folded so that they are not too long, an expert can easily understand how the thickness of each single pile can exceed 10 cm.

To facilitate the presentation of multi-packs, the insertion of a core fitted with a hook along the pile of socks is also known. If the multi-pack comprises several piles, the core can preferably be shared among the various piles, giving the pack continuity. The hook, which is designed to stick out at the top, makes it possible to hang the multi-packs on the specific display units foreseen by the large-scale distribution trade.

Despite being greatly appreciated, this system for packaging sports socks intended for the large-scale distribution trade is not without faults.

Firstly, when the T-end fastener is applied, the socks are often irreparably damaged. The damage occurs when the needle, which applies the fastener, goes directly through a single thread instead of passing between one thread and another of the textile. This frequently cause the fibres of the thread to break, consequently ruining the sock. In fact, unlike a single T-end fastener, which has a minimum diameter, the hollow needle has a relatively high diameter that exceeds 1.3 mm and can even reach 2.3 mm. In fact, the hollow needle must hold the fastener and the applicator piston.

Moreover, while the T-end fastener is held in the hollow needle, it is folded over so that the end is parallel to the axis of the needle. However, the T-end fastener has its own rigidity, which prevents it from being completely comprised within the hollow needle. Therefore, the portion of the T-end fastener that sticks out from the needle along the slit at the side represents a further obstacle.

By virtue of this, when the hollow needle passes through a thread, it almost always breaks it, especially when the latter has been obtained from regenerated yarns, whose short fibres are not particularly resistant.

Moreover, the insertion of the core in the pile of socks presents a further problem when applying the T-end fastener. To be useful for the purposes of presentation in the sales outlet, the core must be strong enough to be able to hold the weight of the pack hanging on the hook. Therefore, the core is made of cardboard or polymer. In view of the typical thicknesses of the piles to be joined together, the needles for applying the T-end fasteners have a considerable unsupported length, which easily causes failing by buckling. This means it is impossible to rely on the hollow needle to perforate the core when applying the T-end fastener. Consequently, the core must already be prepared perforated, introducing the problem of managing to make the needle centre the prepared hole.

The elevated thicknesses of the piles of socks and the presence of the cores cause considerable strain on the needles, which are consequently subject to breaking. Breakage of the needle, in turn, involves a series of important problems. Firstly, the broken tip of the needle remains inside an indeterminate sock that is potentially dangerous for the final customer. Moreover, if a suitable system is not in place for detecting the specific problem along the packaging line, once the needle has broken it continues to work improperly and can easily ruin a considerable number of socks. Finally, once the breakage is detected, the system must be stopped to replace the needle.

The different types of damage highlighted above occur statistically in about 2% of the samples checked. However, a final customer who finds a flawed pair of socks is likely to ask for a replacement of the whole multi-pack. For this reason, the flaw introduced by using T-end fasteners easily rises from about 2% to about 10% percent, a percentage that represents a significant problem for distributors.

The aim of the present invention is thus to overcome the stated inconveniences highlighted above in relation to the prior art.

In particular, it is an object of the present invention to provide packaging for sports socks, which avoids the use of the applicator needle. In this way, it is possible to avoid damaging the socks and breakage of the needle.

Moreover, it is an object of the present invention to provide packaging for sports socks that avoids the need to perforate the core in the pile of socks.

Said aim and said objects are achieved by means of packaging for textile articles according to claim 1 and by means of a method for packaging textile articles according to claim 7.

For a better understanding of the invention and to appreciate its advantages, a few embodiments are described by way of example, which are not limiting, with reference to the accompanying drawings, wherein.

Figure 1:
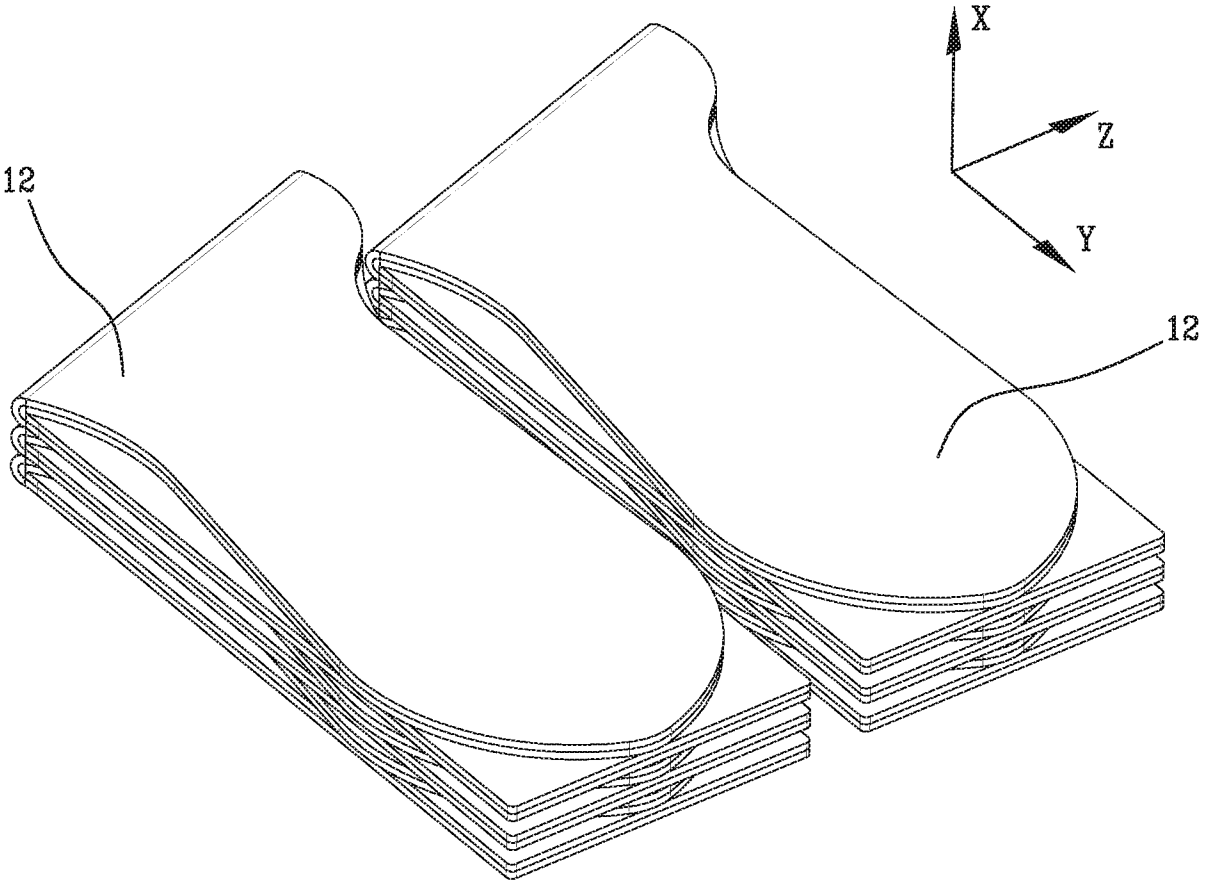
FIG. 1 is a schematic perspective view of a first phase of packaging according to the invention, wherein two partial piles of socks are set side by side.

Packaging for textile articles according to the invention is globally indicated with reference 10 in the accompanying figures.

In the following paper, reference will be made to the direction of the stack of socks forming a single pile. Said direction is called X. The direction in which the single socks of the pile mainly extend is called Y, perpendicular to the X direction. Finally, the perpendicular direction to both of the previous directions is called Z. If the packaging comprises several piles, they are set side by side along the Z direction.

The packaging 10 according to the invention comprises:

- a plurality of textile articles 12 overlapped in an X stacking direction so as to form at least one pile 14;
- a flat core 16 substantially perpendicular to the X stacking direction, wherein the flat core 16 comprises recesses 18 along a pair of sides 160; and
- a small band 20 that surrounds the at least one pile 14 of textile articles 12 and the flat core 16.

In the packaging 10 according to the invention, the small band 20 is tied around the pile 14 so as to keep it together and it is received in the recesses 18 of the flat core 16.

As stated previously, the textile articles 12 represented in the accompanying figures are sports socks, but, as an expert may easily understand, there is nothing to avoid the packaging according to the invention from being used for other textile articles with similar characteristics.

In the embodiment in the accompanying figures, the packaging 10 comprises two piles 14 of textile articles 12. However, the packaging 10 according to the invention can comprise a different number of piles 14, for example just one pile, but also three or more piles.

Figure 2:
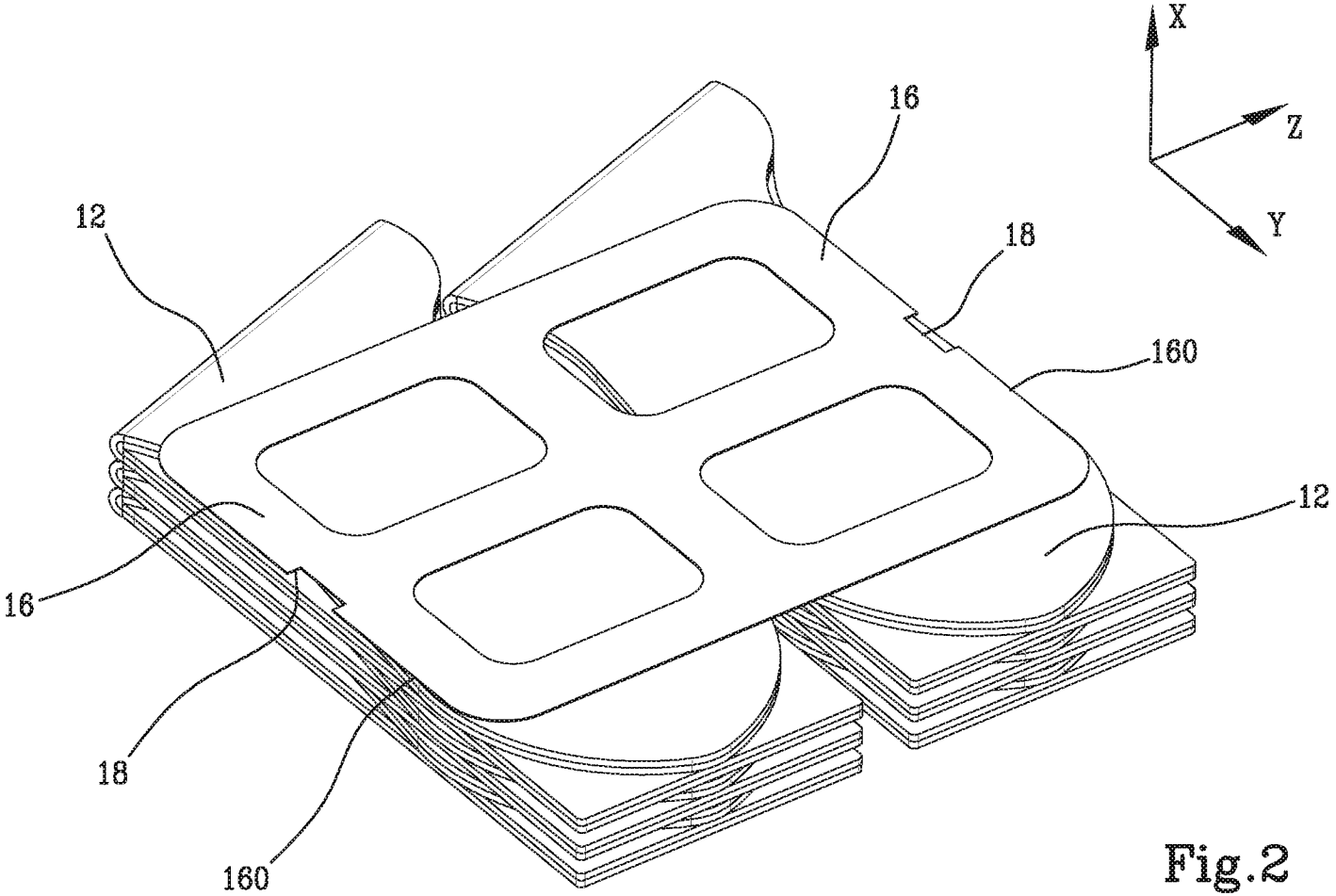
FIG. 2 is a schematic perspective view of a second phase of packaging according to the invention, wherein a core is added.

As can be seen in the accompanying figures, particularly in FIG. 2, the flat core 16 extends prevalently in the YZ plane, perpendicular to the X stacking direction. The fact that the core 16 is defined "flat" simply means that it prevalently extends in the YZ plane, but this does not rule out the possibility of it having a structure, which is not perfectly flat. The flat core 16 can, for example, have a wavy or corrugated structure or it can comprise wings, for example suitable for defining surfaces for containing textile articles 12. The flat core 16 is preferably strong enough to support the packaging 10. The flat core 16 is preferably made of card or cardboard or polymer.

Figure 3:
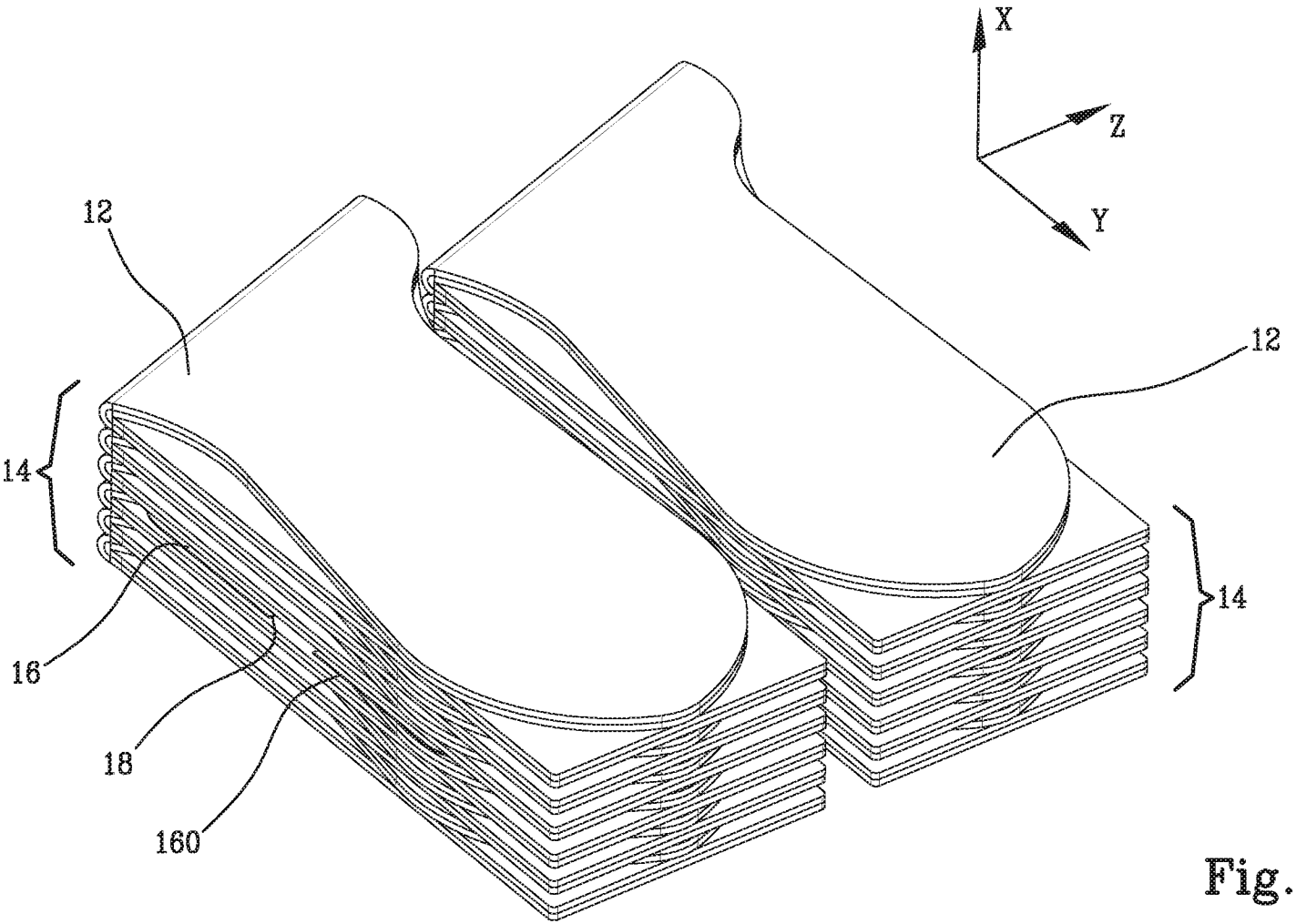
FIG. 3 is a schematic perspective view of a third phase of packaging according to the invention, wherein the two piles of socks are completed.

Figures from 1 to 3 show how the flat core 16 is positioned between the textile articles along the at least one pile 14, more particularly halfway through the piles 14. More specifically, FIG. 1 shows two half piles (each made up of three pairs of socks) set side by side. FIG. 2 shows the addition of the flat core 16, and FIG. 3 shows the addition of the remaining two half piles (each made up of another three pairs of socks). As an expert can easily understand, the position of the flat core 16 can be varied along the pile 14, depending on the specific needs. Similarly, the number of pairs of socks in each pile 14 can be modified according to the specific needs.

As said previously, the flat core 16 comprises a pair of recesses 18, which, as can be seen in FIG. 2, are arranged on the sides 160 parallel to the Y axis.

Figure 4:
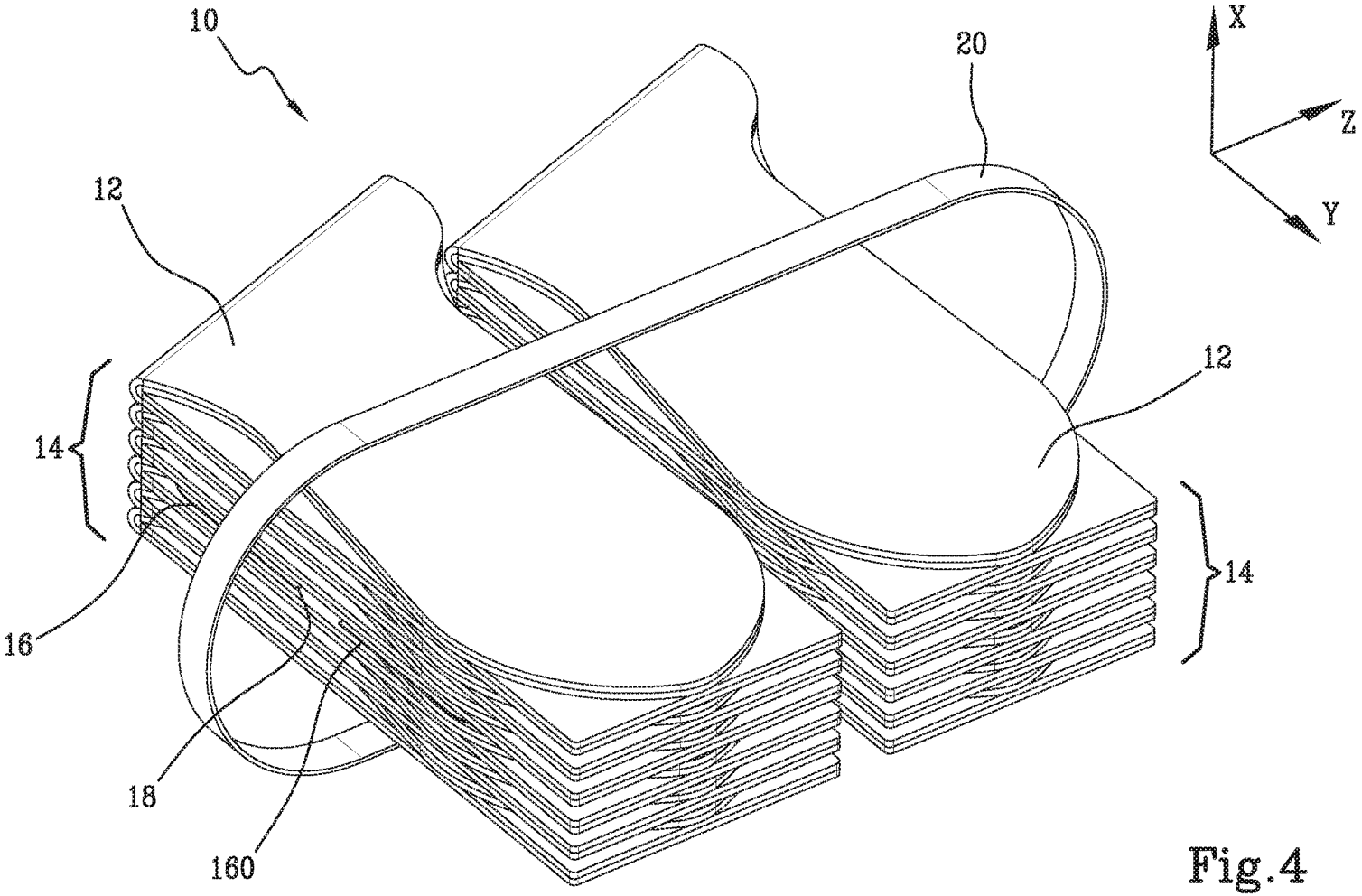
FIG. 4 is a schematic perspective view of a fourth phase of packaging according to the invention, wherein the piles of socks and the core are surrounded by a band.
Figure 5:
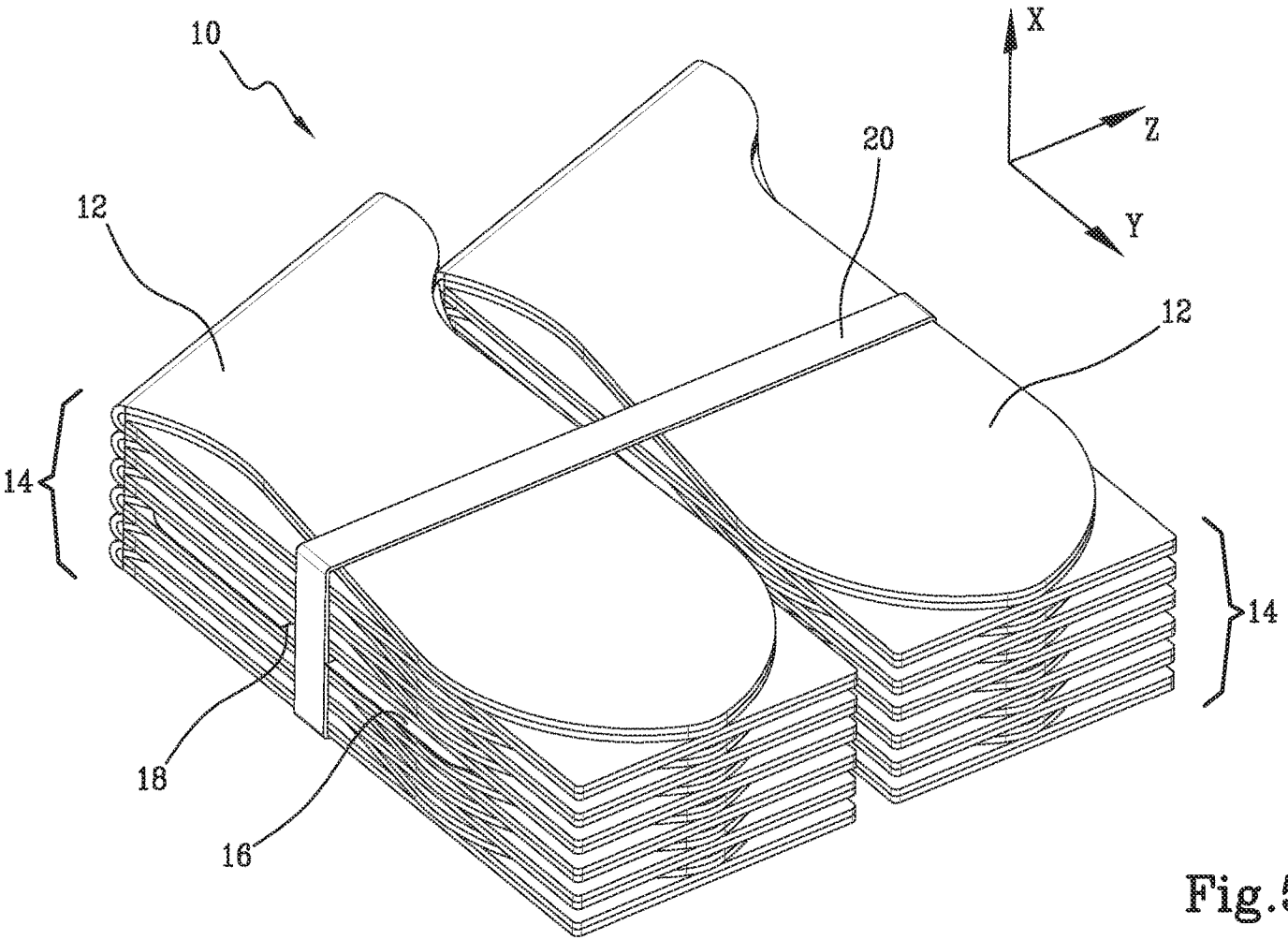
FIG. 5 is a schematic perspective view of a fifth phase of packaging according to the invention, wherein the band is tied to keep the piles of socks together.

As can be seen in FIG. 4, the small band 20 is provided so that it defines a ring with an extension parallel to the XZ plane. Said ring is shaped and arranged so that it surrounds the piles 14 of socks 12 and the flat core 16.

The small band 20 is preferably applied checking the tension and consequently the compression action that it applies on the piles 14 of socks 12. After reaching the desired tension, the small band 20 is locked in position.

The small band 20 is preferably made of polymeric material, for example, polypropylene (PP), polyethylene (PE), polyester (PE) or resin-coated paper, material composed of a paper support where a layer of extruded polyethylene is applied, at least on one side.

The small band 20 preferably has a thickness comprised between 80 μm and 200 μm, even more preferably comprised between 100 μm and 150 μm.

According to one embodiment of the invention, the small band 20 is applied by means of a strapping machine. The strapping machine is a device, known in itself, which can be manual, semi-automatic or automatic. The strapping machine is suitable for conforming the small band 20 in a ring, applying controlled tension to the small band 20 and welding the small band 20 to lock it in the desired position. The welding of the small band 20 is preferably carried out by ultrasound. This type of welding limits the heating of the material only in the contact area between the two ends of the small band 20, without introducing any risks to the socks 12.

In order to satisfy specific needs, in some embodiments it is possible to adopt other types of welding, such as, for example vibration welding, high frequency welding, induction welding, laser welding, heat welding, welding with filler materials and the like.

According to another possible embodiment of the invention, the small band 20 is a self-locking type, for example, wherein one end is shaped as a rack and the other end comprises a ratchet system with an elastic tooth. After inserting the rack inside the ratchet, it can no longer be released, but only one further tightening is possible. In this case, too, it is possible to use a special device, which is known in itself, to give the small band 20 the right tension. The device can also cut the part of the band in excess after reaching the desired tension. In this case, the locking of the small band 20 is purely mechanical and does not pose any risk to the socks 12.

Again, according to other possible embodiments of the invention, the two ends of the small band 20 can be joined together by means of other methods making it possible to satisfy specific needs, such as, for example by gluing or by applying a mechanical connection, such as, for example, a stitch or a clip.

As an expert can easily understand, the tension of the small band 20 must satisfy two contrasting needs. On the one hand, the tension of the small band 20 must be suitable for preventing a single pair of socks in the packaging 10 from accidentally coming out or being removed illicitly along the Y direction. On the other hand, the tension of the small band 20 must not be such as to ruin the socks 12.

Figure 7:
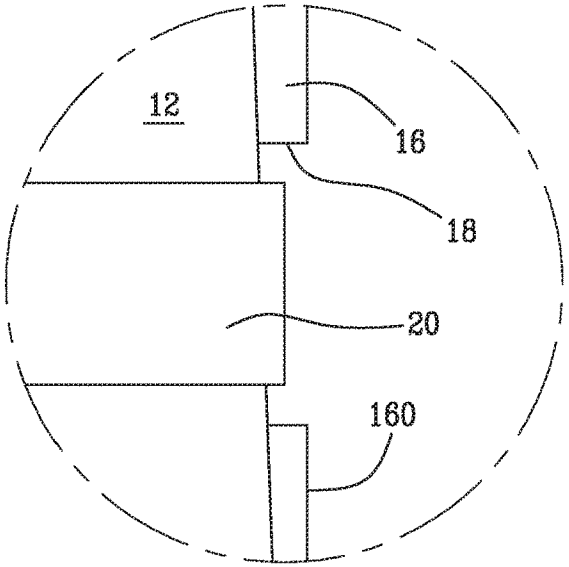
FIG. 7 is a schematic view of the detail indicated by VII in FIG. 6.
Figure 6:
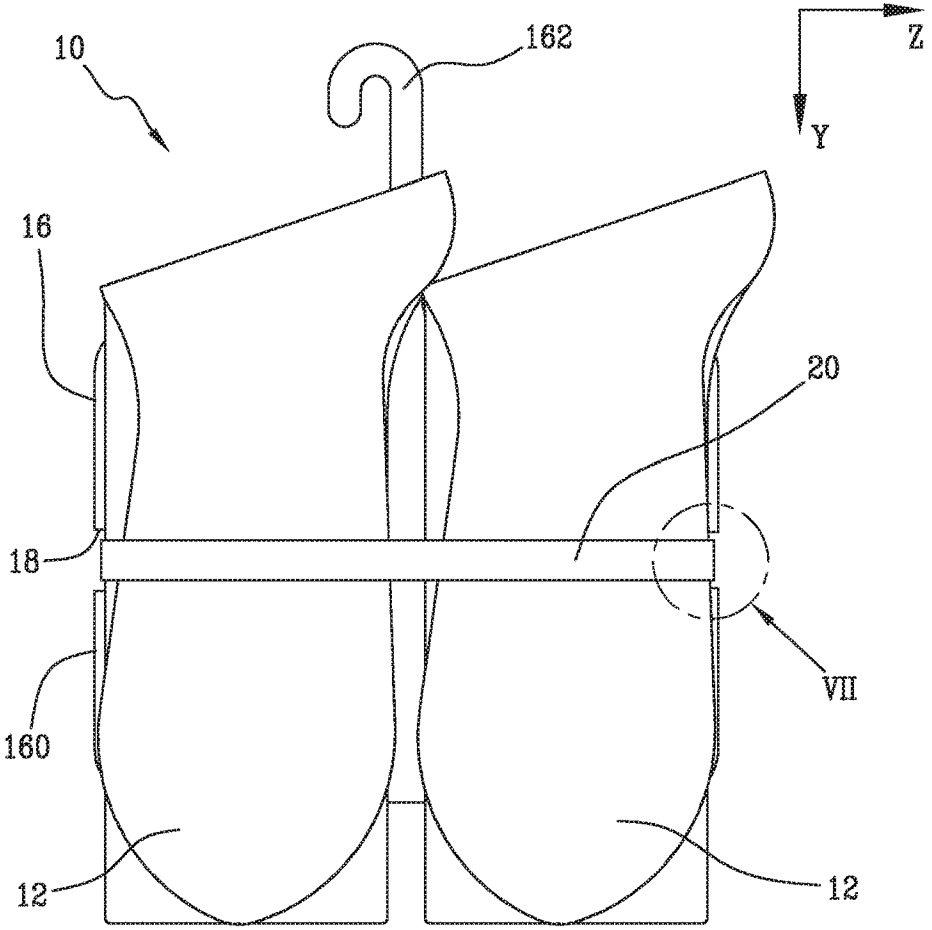
FIG. 6 is a front schematic view of another embodiment of the packaging according to the invention.

The provision of a flat core 16 with an opportune width can provide a useful reference for defining the attainment of the correct tension of the small band 20. In particular, the extension of the flat core 16 in a Z direction, on a level with the recesses 18, can preferably be predetermined for this purpose. On tightening, when the small band 20 is received in the recesses 18 (see in particular the detail in FIG. 7), the correct tension is reached.

The fact that in the packaging 10 according to the invention, the small band 20 is received in the recesses 18 prevents the flat core 16 from being removed from the packaging 10 accidentally or illicitly.

Moreover, the provision of the flat core 16 makes it possible to give the packaging 10 a certain resistance to the compression in the Z direction. In this way, it is possible to prevent the packaging 10 from undergoing excessive compression and taking on an irregular and undesirable shape under the action of the small band 20.

According to various embodiments, the flat core 16 also comprises a hook 162 suitable for sticking out of the packaging 10 in a Y direction. The hook 162, which is known in itself, allows the packaging 10 to be hung on the special display units of the large-scale retail trade.

According to various embodiments, the small band 20 comprises graphic elements suitable for identifying the type of textile products 12 contained in the packaging 10.

According to various embodiments, the packaging 10 according to the invention also comprises an auxiliary outer band. Said auxiliary band, which can be made, for example of a similar material to that of the small band 20 or also of paper or cardboard, is typically suitable for containing graphic elements for identifying the type of textile products 12 contained in the packaging 10. Said graphic elements can be, for example, the brand and information relating to the textile products 12.

According to a further aspect, the invention relates to a method for packaging textile articles 12, in particular sports socks.

The method according to the invention comprises the steps of:

- providing a plurality of textile articles 12;
- overlapping the textile articles 12 in an X stacking direction so as to form at least one pile 14;
- providing a flat core 16 comprising recesses along a pair of sides 160;
- providing the flat core 16 substantially perpendicular to the X stacking direction;
- providing a small band 20;
- forming a ring with the small band 20 so as to surround the at least one pile 14 and the flat core 16;
- tightening the small band 20;
- when the small band 20 is received in the recesses 18 of the flat core 16, locking the small band in position.

Advantageously, the method according to the invention also comprises the step of checking the tension of the small band 20 as it is gradually tightened. This step can simply be carried out by checking the position of the small band in relation to the recesses 18 of the flat core 16, or it can be carried out more specifically, for example by means of a specific function of the device for applying the small band.

As an expert can easily understand, the invention makes it possible to overcome the previously highlighted inconveniences with reference to the prior art.

In particular, the present invention offers a pack for sports socks that avoids using the T-end fastener and the relative applicator needle. In this way, it is possible to avoid both damaging the socks 12 and breakage of the needle.

Moreover, the present invention offers a pack for sports socks that avoids the need for perforating the flat core in the pile of socks.

It is clear that the specific characteristics are described in relation to different embodiments of the pack and method by way of example and not limiting. Obviously, a specialist in the field can make further modifications and variations to the present invention, with the aim of satisfying specific, contingent needs. Said modifications and variations are, however, included within the protective scope of the invention, as defined by the following claims.

The invention claimed is:

1. Packaging (10) of textile articles (12) comprising:

- a plurality of textile articles (12) overlapped in a stacking direction (X), so as to form at least one pile (14);
- a flat core (16) arranged substantially perpendicular to the stacking direction (X), wherein the flat core (16) comprises recesses (18) along a pair of sides (160); and
- a small band (20) that surrounds the at least one pile (14) of textile articles (12) and the flat core (16), wherein the small band (20) is fixed around the pile (14) so as to keep it together and wherein the small band is received in the recesses (18) of the flat core (16);

wherein the packaging (10) is free from the presence of T-end fasteners; and wherein the flat core (16) comprises a hook (162) such that, when the packaging (10) is hung by the hook (162), (a) the flat core (16) extends in a vertical direction and the small band (20) extends in a horizontal direction as it surrounds the at least one pile (14) and the flat core (16), and (b) the feature which prevents the textile articles (12) from falling consists of the small band (20) engaging the recesses (18) and the small band (20) urging, with controlled tension, the textile articles (12) towards and/or into contact with the flat core (16).

2. Packaging (10) according to claim 1, wherein the small band (20) is locked in position by means of ultrasound welding.

3. Packaging (10) according to claim 1, wherein the small band (20) is locked in position by means of vibration welding, high frequency welding, induction welding, laser welding, heat welding, or welding with filler material.

4. Packaging (10) according to claim 1, wherein two ends of the small band (20) are joined by gluing or by applying a mechanical connection.

5. Packaging (10) according to claim 1, wherein the small band (20) comprises graphic elements suitable for identifying the textile articles (12).

6. Method for packaging a plurality of textile articles (12), comprising the steps of:

- providing a plurality of textile articles (12);
- overlapping the textile articles (12) in a stacking direction (X) so as to form at least one pile (14);
- providing a flat core (16) comprising recesses (18) along a pair of sides (160);
- providing the flat core (16) substantially perpendicular to the stacking direction (X);
- providing a small band (20);
- forming a ring with the small band (20) to surround the at least one pile (14) and the flat core (16);
- tightening the small band (20);
- locking the small band in position when the small band (20) is received in the recesses (18) of the flat core (16); the foregoing steps yielding a packaging (10) according to claim 1.

7. Method according to claim 6, further comprising the step of checking the tension of the small band (20) as the small band (20) is gradually tightened.

8. Packaging (10) according to claim 1, wherein the textile articles (12) are socks.

9. Method according to claim 6, wherein the textile articles (12) are socks.

* * * * *